US005940910A

United States Patent [19]

Weismiller et al.

[11] Patent Number: 5,940,910

[45] Date of Patent: Aug. 24, 1999

[54] STEP DECK FOR A BED

[75] Inventors: Matthew W. Weismiller; Gregory W. Branson, both of Batesville; Kenneth L. Kramer, St. Paul, all of Ind.; Philip D. Palermo, Celina, Ohio; David J. Ulrich, Sunman, Ind.; David A. Albersmeyer, Batesville, Ind.; Jason C. Brooke; Eric R. Meyer, both of Greensburg, Ind.; John D. Miller, Brookville, Ind.

[73] Assignee: Hill-Rom, Inc., Batesville, Ind.

[21] Appl. No.: 09/026,054

[22] Filed: Feb. 19, 1998

Related U.S. Application Data

[63] Continuation of application No. 08/511,547, Aug. 4, 1995, Pat. No. 5,724,685.

[51] Int. Cl.[6] ..... A47C 27/15; A47C 21/08; A61G 7/015

[52] U.S. Cl. ..... 5/600; 5/613; 5/618

[58] Field of Search ..... 5/600, 613, 617, 5/618, 624

[56] References Cited

U.S. PATENT DOCUMENTS

| | | |
|---|---|---|
| 1,398,203 | 11/1921 | Schmidt . |
| 2,091,014 | 8/1937 | Saak . |
| 2,452,366 | 10/1948 | Freund . |
| 2,722,017 | 11/1955 | Burst et al. . |
| 3,220,022 | 11/1965 | Nelson . |
| 3,932,903 | 1/1976 | Adams et al. . |
| 4,183,015 | 1/1980 | Drew et al. . |
| 4,258,445 | 3/1981 | Zur . |
| 4,369,535 | 1/1983 | Ekkerink . |
| 4,411,035 | 10/1983 | Fenwick . |
| 4,615,058 | 10/1986 | Feldt . |
| 4,653,129 | 3/1987 | Kuck et al. . |
| 4,858,260 | 8/1989 | Failor et al. . |
| 5,083,334 | 1/1992 | Huck et al. . |
| 5,129,117 | 7/1992 | Celestina et al. . |
| 5,144,707 | 9/1992 | Callaway et al. . |
| 5,179,744 | 1/1993 | Foster et al. . |
| 5,245,716 | 9/1993 | Callaway et al. . |
| 5,454,126 | 10/1995 | Foster et al. . |

FOREIGN PATENT DOCUMENTS

| | | |
|---|---|---|
| 163976 | 7/1955 | Australia . |

*Primary Examiner*—Michael F. Trettel
*Assistant Examiner*—Robert G. Santos
*Attorney, Agent, or Firm*—Barnes & Thornburg

[57] ABSTRACT

A bed including a stepped deck is provided which is configured to support a mattress including a lower mattress section and an upper mattress section. The deck includes an upper deck, and a lower deck coupled to the upper deck by a deck side wall so that the lower deck is spaced apart from the upper deck to define a recess of the deck. The lower deck is configured to support the lower mattress section within the recess of the deck with the bottom surface of the lower mattress section engaging the lower deck. The side wall of the deck is configured to be located adjacent the side wall of the lower mattress section. The top surface of the lower mattress section is aligned generally in a plane of the upper deck. The upper deck is configured to support the upper mattress section with the top surface of the upper mattress section extending above the upper deck to provide a body support surface. The bottom surface of the upper mattress section engages the upper deck. A side rail coupled to the bed has a tucked position between the upper and lower decks.

38 Claims, 8 Drawing Sheets

STEP DECK FOR A BED

This application is a continuation of Ser. No. 08/511,547, filed Aug. 4, 1995, now U.S. Pat. No. 5,724,685.

BACKGROUND AND SUMMARY OF THE INVENTION

The present invention relates to beds and other patient-supporting devices, and particularly to a deck for supporting a mattress on a bed or other patient-supporting device. More particularly, the present invention relates to a step deck for a hospital bed, a patient-care bed, a stretcher, a gurney, or other devices having a support surface for supporting a person in a generally supine position. The deck or "step deck" as it is referred to herein has a central, longitudinally extending deck portion and raised or elevated longitudinally extending upper deck portions along the sides. The step deck carries a mattress or pad and in some embodiments the step deck can be configured to articulate so that the step deck assumes a variety of positions.

Beds and examination tables having articulating decks to adjust the position of the person on the support surfaces thereof are known in the art. See, for example, U.S. Pat. Nos. 5,077,843 to Foster L. Dale et al., 5,157,800 to Borders, 5,129,177 to Celestina et al., 4,862,529 to Peck, and 4,751,754 to Baily et al., all of which are assigned to the assignee of the present invention, and U.S. Pat. Nos. 3,281,141 to Smiley et al., 5,279,010 to Ferrand et al., 4,183,109 to Howell, 4,411,035 to Fenwick, and 3,220,022 to Nelson, as well as German publication No. 716981. Each of these references discloses a bed or an examination table having a top surface that articulates to adjust the position of the person on the surface. See also U.S. Pat. No. 5,715,548, the specification of which is herein incorporated by reference.

According to the present invention, a support assembly such as a bed, a stretcher, a gurney, or the like, is provided for supporting a person in a supine or generally supine position. The support assembly comprises a deck having an upper deck portion and a central, longitudinal recess in the upper deck portion. The recess is defined by a lower deck portion and walls connecting the lower and upper deck portions.

The support assembly can also include a mattress that rests on the deck. The mattress includes a generally planar, upwardly-facing support surface, side portions resting on the upper deck portions, and a central portion or projection extending downwardly into the recess. If desired, the central portion of the mattress can conform to the shape of the deck to nest in the recess and engage at least a portion of the side wall of the deck so that the central portion cooperates with the side walls to minimize lateral and longitudinal sliding of the mattress relative to the bed.

In preferred embodiments, the bed includes a base frame, an intermediate frame coupled to the base frame, a weigh frame coupled to the intermediate frame, and an articulating deck coupled to the weigh frame. The articulating deck has longitudinally spaced head, seat, thigh, and foot sections. The head, thigh, and foot sections are movable relative to each other and are movable relative to the seat section which is fixed relative to the weigh frame. The head, thigh, and foot sections are infinitely adjustable to allow the bed to attain any desired position within the range of movement of the head, thigh, and foot sections, thus accommodating changes of position of a person on the bed. The illustrative articulating deck can provide a planar, horizontal sleeping surface, a planar sleeping surface that is tilted toward either the head end of the bed or the foot end of the bed, and a non-planar chair-shaped seating surface, in addition to the intermediate positions therebetween.

The bed can include a mechanism for raising and lowering the articulating deck and the sleeping surface between a low position and a raised position relative to the base of the bed. In addition, the bed can also include mechanisms for independently raising and lowering each of the head section, the thigh section, and the foot section so that the bed can assume many positions.

A pair of side rails can be provided on each side of the bed. Each pair of side rails includes a head section side rail that is movable with the pivoting head section of the deck and a body section side rail that is mounted to the weigh frame. Each side rail has a top and a bottom and is preferably maintained in a generally vertical orientation adjacent to the sides of the bed.

The side rails are each movable between a downward tucked position and an upward patient-restraining position restraining the movement of a person on the sleeping surface past the sides of the sleeping surface. When in the patient-restraining position, the bottoms of the side rails are positioned to lie above the upper deck side portions and the side rails advantageously abut sides of the mattress. This feature reduces the likelihood that a patient may be trapped between the mattress and the side rails. When in the tucked position, the tops of the side rails are positioned to lie beneath the upper deck side portions in a niche defined by the upper deck side portions and the side walls connecting the lower deck to the upper deck side portions.

It is also an object of the present invention to provide a bed for supporting a person, the bed being convertible between a sitting position and a bed position. The bed includes a frame and an articulating deck on the frame. The deck includes longitudinally spaced head, seat, and foot sections movable relative to each other to accommodate changes of the position of the bed. The deck sections have longitudinally extending upper side deck portions. The deck further includes a central, longitudinally extending recess defined by a lower deck portion and walls connecting the upper and lower deck portions. The bed further includes a mattress resting on the articulating deck. The mattress has a planar, upwardly-facing support surface, side portions resting on the upper deck portions, and a central projection extending downwardly into the recess.

In preferred embodiments of the bed, the step deck includes a head end and a foot end, and the head and foot ends of the deck are provided with upper deck end portions and walls connecting the lower deck to the upper deck end portions. In addition, the sleeping surface is generally planar and the projection is centrally located beneath the sleeping surface to form a thick centrally located portion of the mattress. The varied thickness of the mattress provides the mattress with "zones" including a thick body-support zone adjacent to the projection and a thin zone in areas away from the projection. The portion of the mattress adjacent to the upper deck portions form a thin perimetral zone engaging the upper deck portion.

The mattress may be provided in more than one piece, for example, a first mattress piece could fit into the recess and a second mattress piece could engage the upper deck portion and surround the first mattress piece, or a first mattress piece could fit into the recess and a second mattress piece could cover the first mattress piece and engage the upper deck portion. However, a one-piece mattress including both the body-support zone and the perimetral zone is presently preferred.

The mattress additionally includes mattress sides connecting the sleeping surface and the bottom surface of the mattress. The step deck is configured so that the mattress sides are exposed, rather than being partially covered by a frame or an upstanding wall of a deck. Exposure of the mattress sides above the step deck maximizes the access of the caregiver to the mattress.

Additionally, the mattress in accordance with the present invention is thinner along the perimetral zone of the mattress where the mattress engages the upper deck portions of the articulating deck, providing "rammed edges" that increase firmness experienced by the person around the edges of the mattress. This increased firmness is advantageous when the person enters and exits the bed along the sides of the bed. In addition, the mattress is thicker in the body-support zone that carries a greater portion of the weight of the person for most of the time that the person is carried by the bed, for example toward the center of the head, seat, and thigh portions of the mattress, maximizing the comfort of the person.

The mattress includes a head mattress portion, a seat mattress portion, a thigh mattress portion, and a foot mattress portion. Each named mattress portion is associated respectively with the head, seat, thighs, and feet of the person resting on the sleeping surface of the bed as well as with the underlying head, seat, thigh, and foot sections of the deck.

The step deck and the mattress configured for use with the step deck can be used independently of the bed and the articulating deck. For example, the step deck can be provided for a stretcher having a frame, a step deck mounted to the frame, the step deck having longitudinal upper side portions, and a mattress having a generally planar sleeping surface and a bottom surface including a downwardly extending projection. In the same manner, a step deck and associated mattress could be provided for a gurney. Such a gurney would be similar to the illustrative stretcher described above except that the frame would include wheels so that the gurney could be transported by rolling it from place to place.

Though there are many potential variations of step deck shapes and corresponding mattress shapes and numbers and types of mattress pieces that could be devised, any step deck having an upper deck portion and a recess defined by a bottom deck portion and walls connecting the bottom and the upper deck portions would achieve the desired results. Likewise, any mattress or combination of mattress pieces that provide a bottom surface generally conforming to the shape of the step deck would achieve the desired results.

It is still another object of the present invention to provide a bed with cooperating step deck and side rail features. The bed has a head end, a foot end, and two opposing sides, and comprises a frame and a deck carried by the frame. The deck includes an upper deck portion and a central, longitudinally extending recess in the upper deck portion. The recess is defined by a lower deck portion and walls connecting the lower and upper deck portions. The bed further includes a side rail coupled to the bed below the upper deck portion and positionable in a patient-restraining position above the upper deck portion and in a tucked position below the upper deck portion.

The side rails are mounted to the articulating deck and to the weigh frame for movement between the patient-restraining position and the tucked position. The mounting mechanism causes the side rails to rotate downwardly when released from the patient-restraining position, first rotating outwardly and downwardly and then inwardly and downwardly to the tucked position which is beneath the patient-restraining position. The rotating action of the mounting mechanism positions the tucked side rails and the mounting mechanism so that clearance between the side rails and the floor is maximized. The positioning of the side rails beneath the deck when in the tucked position also helps caregivers to improve the positioning of the person when moving the person on and off of bed.

As described above, the mattress of the bed includes a thick mattress portion and a thin mattress portion engaging the upper deck portions along the sides of the deck. As a result, the upper deck side portions are typically farther from the floor than the bottom of the step deck. This allows the side rails to be mounted farther from the floor than would be found on a bed without the step deck. This positioning provides additional obstruction-free space between the tucked side rails and the floor for access under the deck, for example, for equipment such as a C-arm having portions above and below the deck.

In addition, when the side rails are in the patient-restraining position, the distance between the bottom of each side rail and the top of each upper deck portion is minimized. The side rails are positioned above the deck and can abut the side of the mattress. A bed having a conventional deck, a conventional mattress of uniform thickness, and side rails mounted at a height relative to the sleeping surface similar to that found in the bed of the present invention would also have the bottoms of the side rails further from the conventional deck than is found in the present invention, resulting in a larger gap between the bottom of the side rail and the conventional deck. Use of the step deck provides upper deck portions which are positioned to lie closer to the bottoms of the side rails, thus minimizing the gap between the deck and the bottoms of the side rails and minimizing the possibility of a person sliding through the gap.

It is a further object of the present invention to provide a bed having a unique combination of a step deck and a pivoting and contracting foot section. The bed has a head end, a foot end, and two opposing sides, and is convertible between a sitting position and a bed position. The bed includes a frame and a deck carried by the frame. The deck has an upper deck portion and a central, longitudinal recess in the upper deck portion, the recess being defined by a lower deck portion and walls connecting the lower and the upper deck portions. The deck further includes a foot section that is pivotably coupled to the deck. The deck foot section contracts and expands between a first length and a second length, the first length being greater than the second length.

The foot section has a head end toward the head of the bed and a foot end toward the foot of the bed. The head end of the foot section is pivotably coupled to the upper deck portion. The foot section can include a pivoting member pivotably coupled to the upper deck end portion for movement about a pivot axis and a sliding contracting member slidably coupled to the pivoting member. The contracting member can be configured to translate radially inwardly and radially outwardly relative to the pivot axis.

The step deck includes an upper deck end portion positioned to lie longitudinally between the thigh section and the foot section, and spanning the width of the bed between the upper deck side portions. The upper deck portions, including the upper deck end portion, are positioned to lie in a first horizontal plane that is above a second horizontal plane defined by the lower deck. The vertical distance between the first and second horizontal planes is the vertical offset.

The pivoting member of the foot section is mounted to the upper deck end portion rather than to the lower deck. Consequently, the foot section, when in the down position, can be longer by an amount equal to the vertical offset than it could be if there were no step deck, and the foot section were instead connected to the lower deck. Thus, for the foot section to clear the floor when the pivoting member of the foot section pivots from the up position to the down position, the contracting member of the foot section can contract a lesser amount than would be required if there were no step deck.

The mattress carried on the step deck includes a foot portion adjacent to the foot section of the bed. The foot portion of the mattress can be configured to shorten in conjunction with the contraction of the foot section. Also, the foot portion of the mattress can automatically become thinner to maintain an appropriately sized seat area as the foot section pivots downwardly. To achieve this result, the foot portion of the mattress can be inflatable and can be inflated when the foot section is in the up position. When the foot portion of the mattress is inflated, the foot portion cooperates with the other mattress portions to provide a generally planar sleeping surface. The foot portion of the mattress is automatically deflatable and inflatable and automatically inflates and deflates as the foot section of the deck pivots between the up position and the down position.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE ILLUSTRATIVE AND PREFERRED EMBODIMENTS

Figure 1:
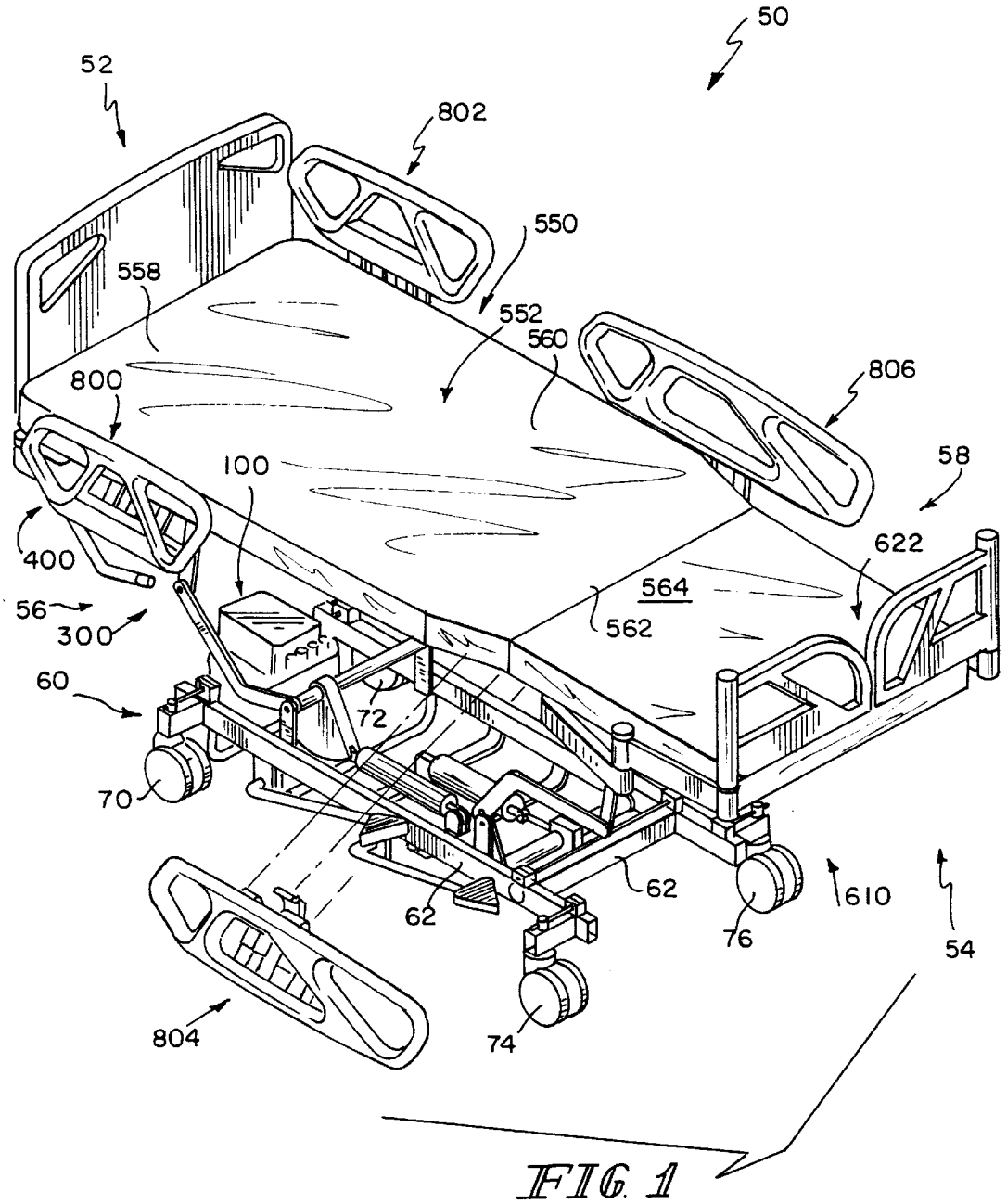
FIG. 1 is a perspective view of a chair bed in accordance with the present invention showing a side rail exploded away from the chair bed, head side rails and foot side rails positioned along longitudinal sides of the deck, and a swinging foot gate in a closed position.

A chair bed 50 in accordance with the present invention having a head end 52, a foot end 54, and sides 56, 58 is illustrated in FIG. 1. As used in this description, the phrase "head end 52" will be used to denote the end of any referred-to object that is positioned to lie nearest head end 52 of chair bed 50. Likewise, the phrase "foot end 54" will be used to denote the end of any referred-to object that is positioned to lie nearest foot end 54 of chair bed 50.

Chair bed 50 includes a base module 60 having a base frame 62 connected to an intermediate frame module 300 by lift arms 320, 322, 324, 326 as shown in FIG. 1. An articulating deck/weigh frame module 400 is coupled to intermediate frame module 300 by load beams 330, 336, 342, 348. Side rail assemblies 800, 802, 804, 806 and an extended frame module 610 having a swinging foot gate 622 are coupled to articulating deck/weigh frame module 400. A mattress 550 is carried by articulating deck/weigh frame module 400 and provides a sleeping surface or support surface 552 configured to receive a person (not shown).

Chair bed 50 can be manipulated by a caregiver or by a person (not shown) on sleeping surface 552 using hydraulic system module 100 so that mattress 550, an intermediate frame 302 of intermediate frame module 300, and an articulating deck 402 of articulating deck/weigh frame module 400 assume a variety of positions, several of which are shown diagrammatically in FIGS. 3–7.

Articulating deck 402 includes a head section 404, a seat section 406, a thigh section 408, and a foot section 410. Mattress 550 rests on deck 402 and includes a head portion 558, a seat portion 560, a thigh portion 562, and a foot portion 564, each of which generally corresponds to the like-named portions of deck 402, and each of which is generally associated with the head, seat, thighs, and feet of the person on sleeping surface 552. Details of deck 402 and mattress 550 will be explained hereinafter.

Figure 3:
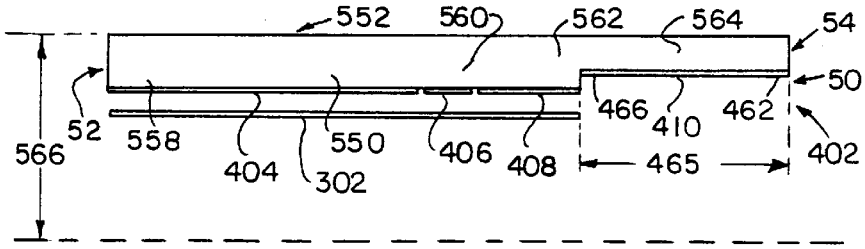
FIG. 3 is a diagrammatic view of the chair bed of FIG. 1 showing the chair bed in a bed position including a mattress having an upwardly-facing sleeping surface held a predetermined first distance above the floor, the deck being in an initial position supporting the sleeping surface in a generally planar configuration, and the foot section being a first length.
Figure 4:
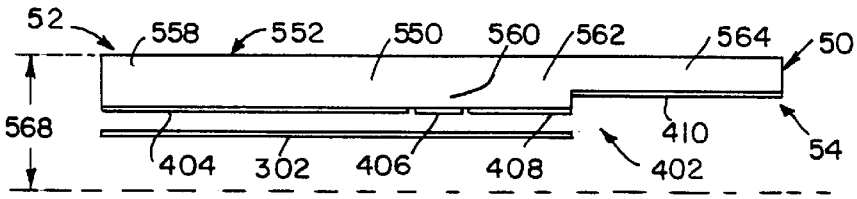
FIG. 4 is a diagrammatic view showing the chair bed in a low position.

Chair bed 50 can assume a bed position having deck 402 configured so that sleeping surface 552 is planar and horizontal, defining an initial position of deck 402 as shown in FIG. 1 and as shown diagrammatically in FIG. 3. In the bed position, sleeping surface 552 is a predetermined first distance 566 above the floor. Chair bed 50 can also be manipulated to assume a low position shown diagrammatically in FIG. 4 having deck 402 in the initial position and having sleeping surface 552 a predetermined second distance 568 above the floor, the second distance 568 being smaller than first distance 566. The foot section 410 of the articulating deck 402 has a first length 465 when the deck 402 is in the initial position.

Figure 5:
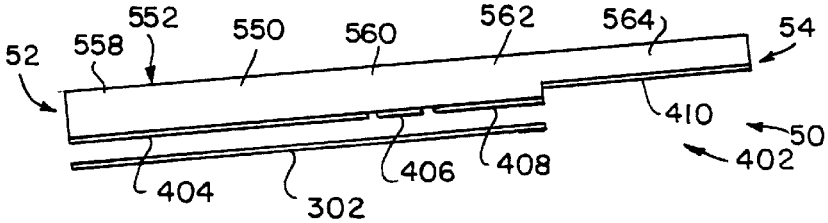
FIG. 5 is a diagrammatic view showing the chair bed in a Trendelenburg position.
Figure 6:
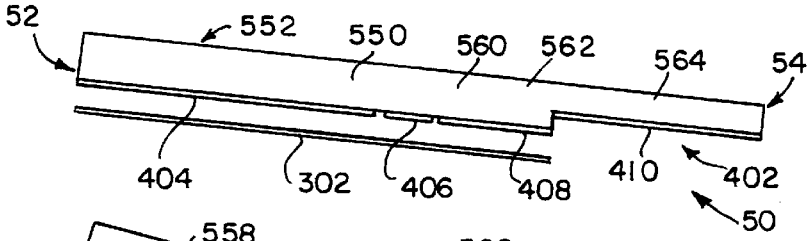
FIG. 6 is a diagrammatic view showing the chair bed in a reverse Trendelenburg position.
Figure 7:
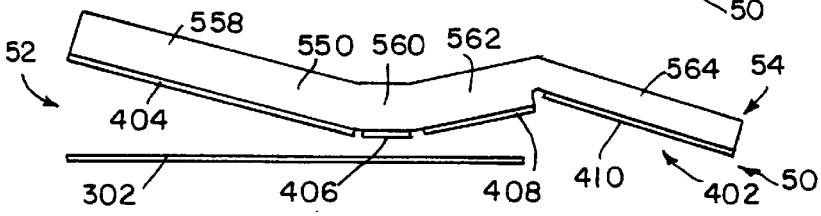
FIG. 7 is a diagrammatic view showing the chair bed in an intermediate position having a head end of a head section of the deck pivoted slightly upward from the initial position of the deck, a seat section positioned to lie in the horizontal plane defined by the seat section in the initial position of the deck, and the foot section being inclined slightly so that the foot end of the foot section lies below the position of the foot section when the deck is in the initial position of the deck.

Chair bed 50 can be moved to a Trendelenburg position shown diagrammatically in FIG. 5 having deck 402 in a planar configuration and tilted so that head end 52 of sleeping surface 552 is positioned to lie closer to the floor than foot end 54 of sleeping surface 552. Chair bed 50 can also achieve a reverse Trendelenburg position shown diagrammatically in FIG. 6 having deck 402 in a planar configuration and tilted so that foot end 54 of sleeping surface 552 is positioned to lie closer to the floor than head end 52 of sleeping surface 552.

Figure 2:
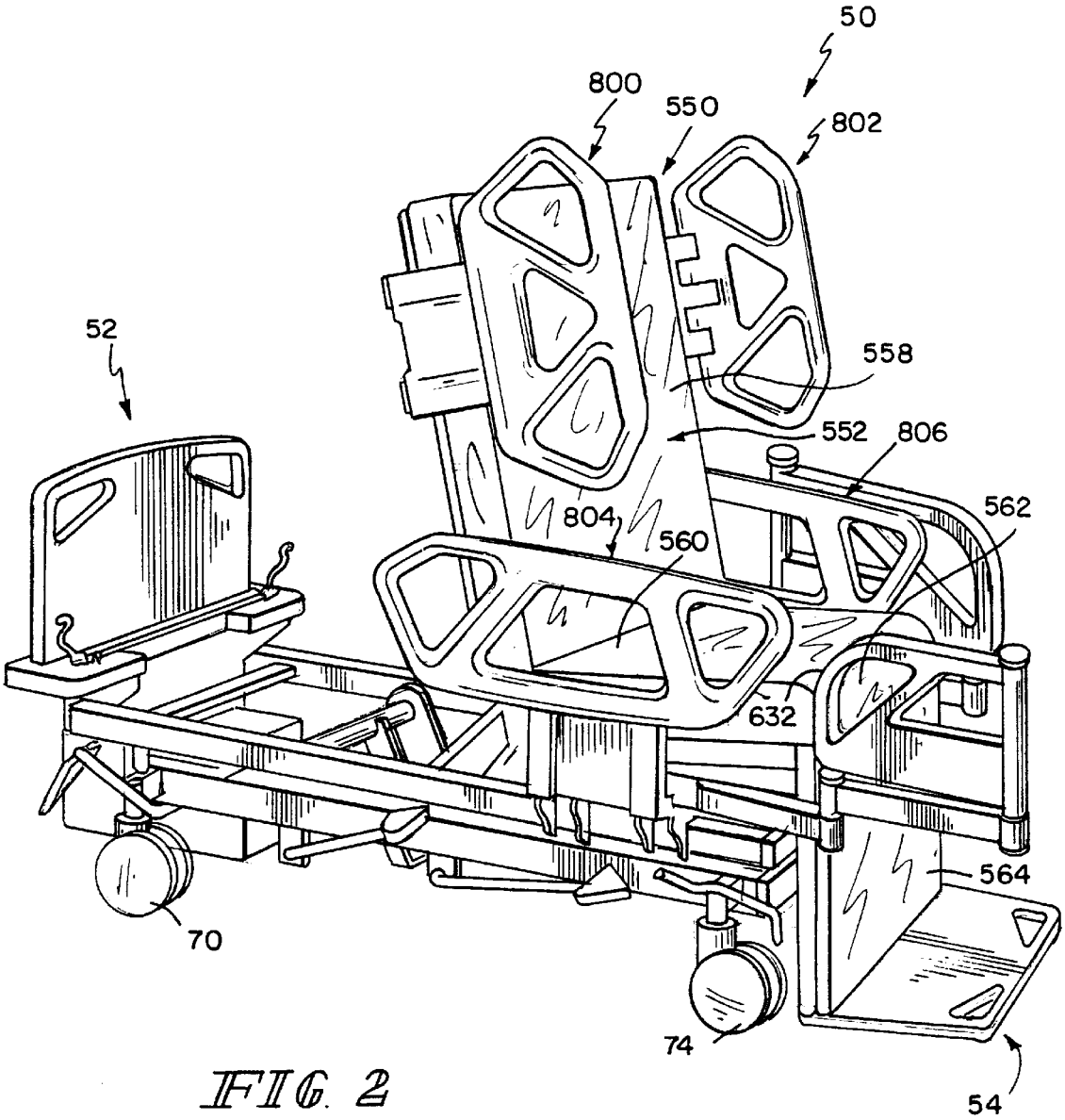
FIG. 2 is a view similar to FIG. 1 showing the chair bed in the sitting position having a head section of an articulating deck moved upwardly to a back-support position, a thigh section of the deck inclined slightly upwardly, a foot section of the deck moved to a generally vertical downwardly extending down position, a foot portion of the mattress being deflated, and swinging gates moved to an open position with one swinging gate folded next to the chair bed.
Figure 8:
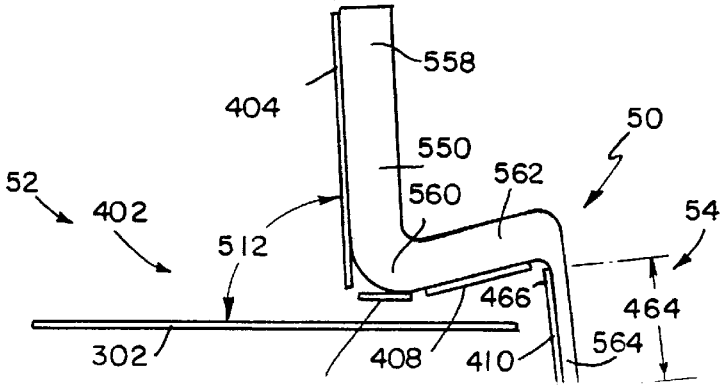
FIG. 8 is a diagrammatic view showing the chair bed in a sitting or chair position with the head end of the head section pivoted upwardly away from the seat section to a back-support position, the seat section lying generally horizontal as in the initial deck position, the thigh section being raised upwardly, the foot section extending downwardly from the thigh section and being a second shorter length, and the portion of the mattress over the foot section being deflated.
Figure 9:
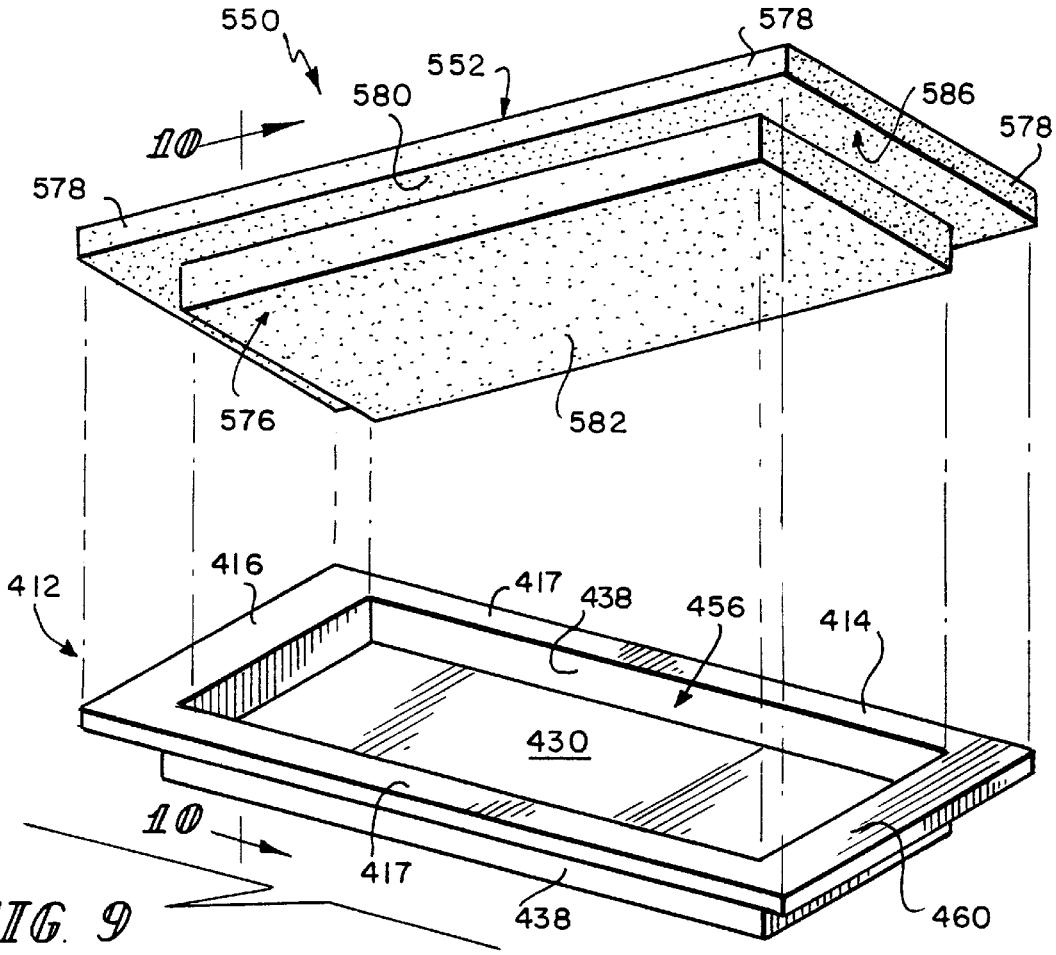
FIG. 9 is a perspective view of a first embodiment of a step deck and a mattress in accordance with the present invention.

As described above, chair bed 50 is convertible to a sitting position shown in FIG. 2 and shown diagrammatically in FIG. 8. In the sitting position, head end 52 of head section 404 of deck 402 is pivoted upwardly away from intermediate frame 302 to a back-support position providing a pivotable backrest so that head section 404 and intermediate frame 302 form an angle 512 generally between 55 and 90 degrees. Seat section 406 of deck 402 is positioned to lie generally horizontally as in the initial position, foot end 54 of thigh section 408 is slightly upwardly inclined, and foot section 410 of deck 402 extends generally vertically downwardly from thigh section 408 and has a length 464 that is shorter than when deck 402 is in the initial position. Foot portion 564 of mattress 550 is inflatable and is in a deflated condition when chair bed 50 is in the sitting position. Foot portion 564 of mattress 550 is thinner and shorter when deflated than when inflated.

Chair bed 50 is capable of assuming positions in which head, thigh, and foot sections 404, 408, 410 of deck 402 are in positions intermediate to those shown in FIGS. 3 and 8. For example, chair bed 50 can assume an intermediate position shown diagrammatically in FIG. 7, having head end 52 of head section 404 of deck 402 pivoted slightly upwardly from the initial position, seat section 406 positioned to lie in the same generally horizontal plane as in the initial position, foot end 54 of thigh section 408 raised slightly upwardly from the initial position, and foot section 410 being inclined so that foot end 54 of foot section 410 lies below head end 52 of foot section 410.

Figure 10:
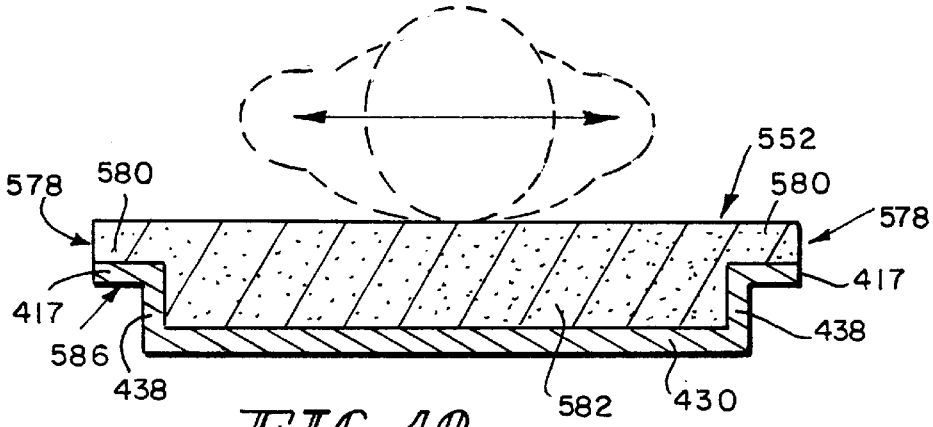
FIG. 10 is a sectional view taken along line 10—10 of FIG. 9 showing the bottom of the step deck beneath the projection.
Figure 11:
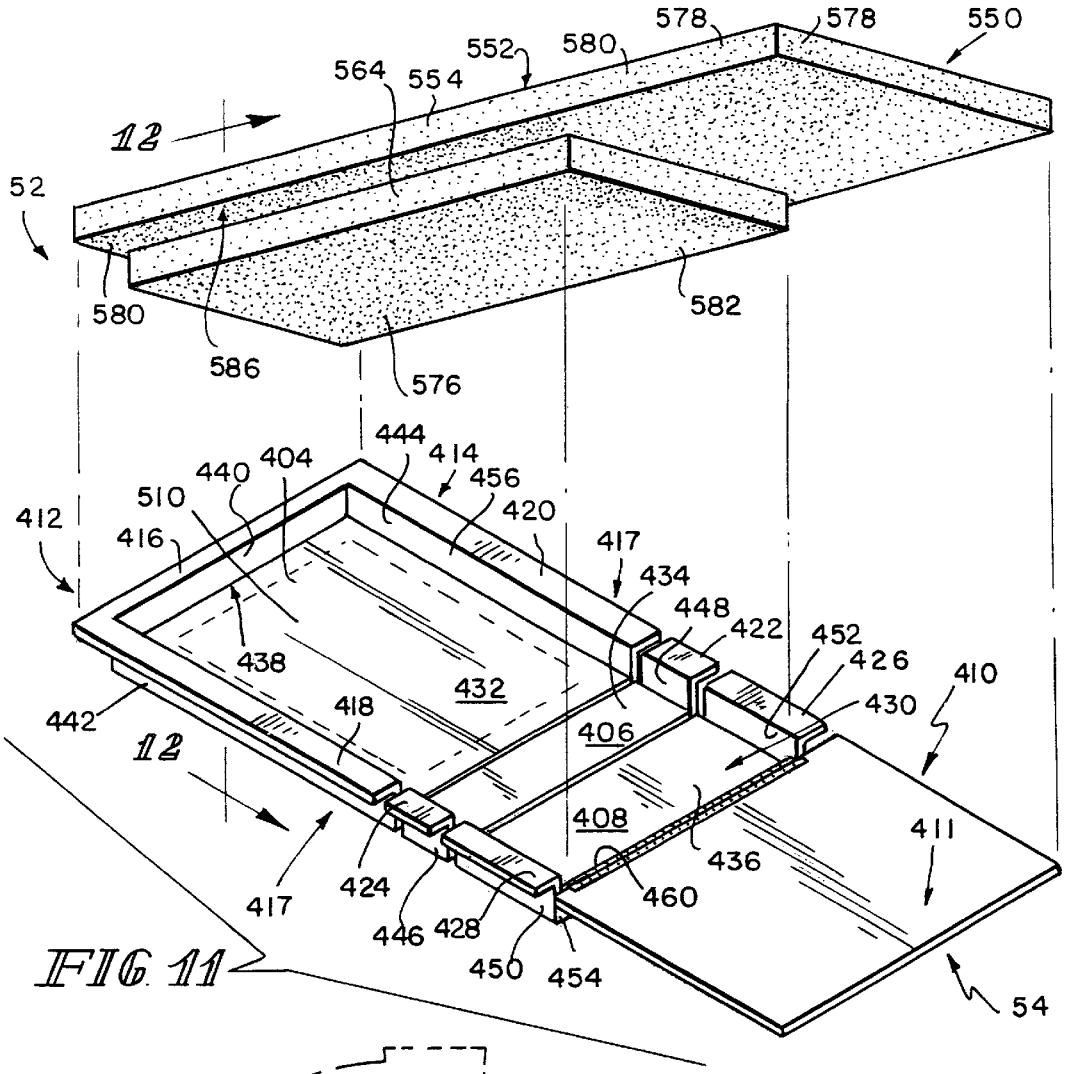
FIG. 11 is an exploded perspective view of a second embodiment of a step deck and the mattress of the chair bed.
Figure 12:
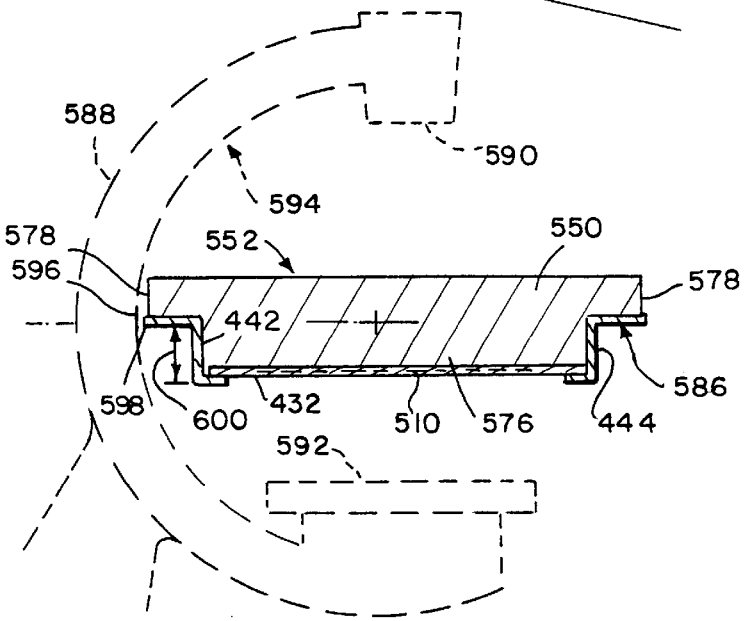
FIG. 12 is a sectional view taken along line 12—12 of FIG. 11 of the step deck and the mattress and showing a C-arm (in phantom) for holding medical equipment such as fluoroscopic equipment.
Figure 13:
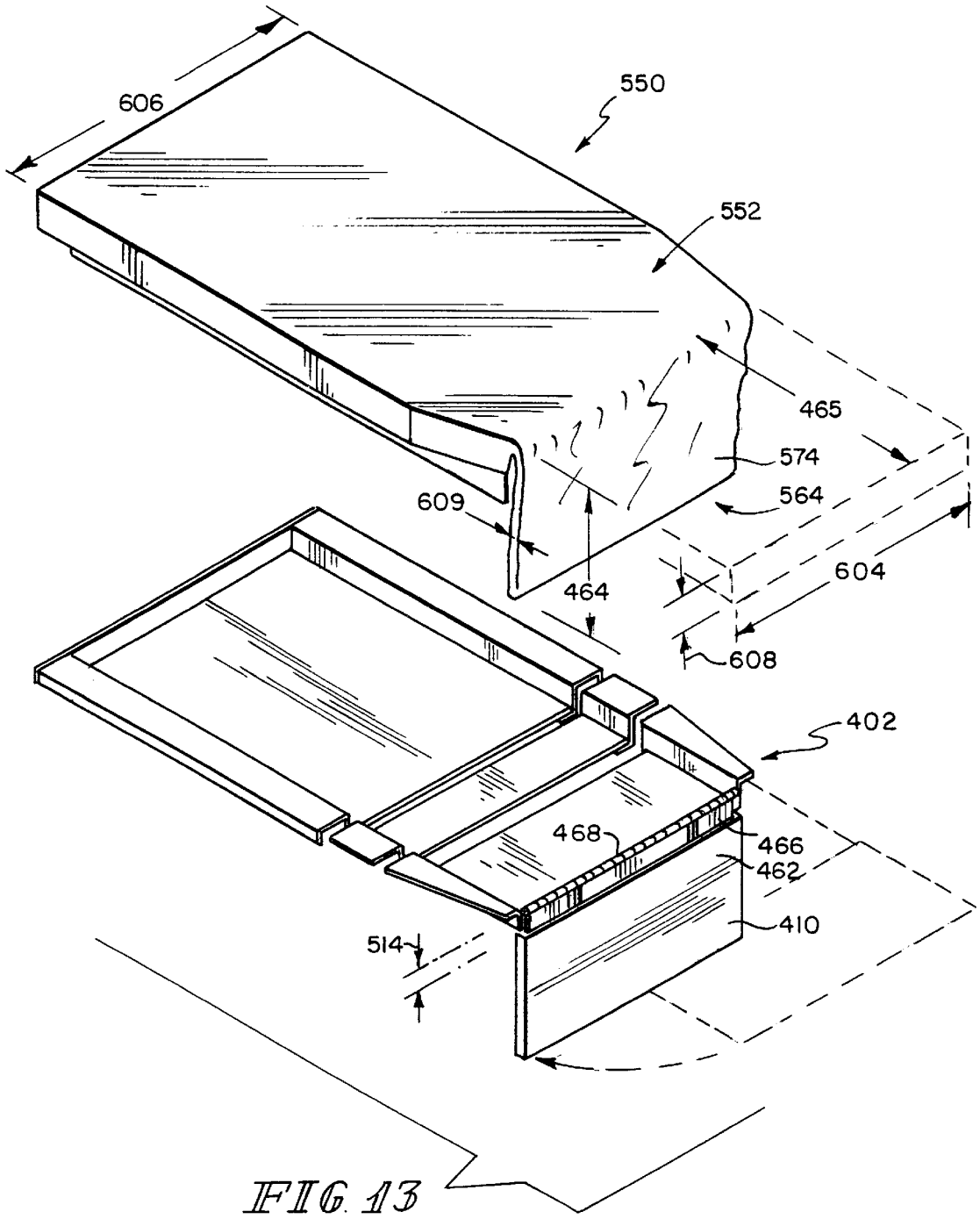
FIG. 13 is an exploded perspective view of a third embodiment of the mattress and the deck showing the foot section of the deck and the foot portion of the mattress in a minimized condition having the foot section of the deck contracted and the foot portion of the mattress contracted longitudinally and deflated so that the foot portion of the mattress is thinner and shorter than when foot portion is inflated.

Additionally, articulating deck 402 of chair bed 50 is configured as a step deck 412 as shown illustratively along with illustrative step mattress 550 in FIGS. 9, 10, and 11–13. The step deck and mattress of FIGS. 11–13 are those illustrated in FIGS. 3–8. Step deck 412 includes an upper deck 414 and a central, longitudinally extending recess 456 defined by a lower deck 430 of step deck 412 and a wall 438 surrounding recess 456 and connecting lower deck 430 to upper deck 414. Upper deck 414 includes longitudinally extending upper deck side portions 417, a head end upper deck end portion 416, and a foot end upper deck end portion 460.

Mattress 550 includes a generally upwardly-facing sleeping surface 552 and a bottom surface 586 that is generally parallel to sleeping surface 552 and that is positioned to lie beneath sleeping surface 552. A perimetral side 578 connects sleeping surface 552 and bottom surface 586. A projection 576 is appended to bottom surface 586 and extends downwardly therefrom. Preferably, projection 576 is spaced-apart from sides 578 of mattress 550 and nests in recess 456. Projection 576 may engage wall 438 of step deck 412 to prevent movement of mattress 550 relative to step deck 412 and to maintain the generally central position of mattress 550 on deck 412.

Preferably, mattress 550 is provided with a thick zone 582 adjacent to recess 456 and projection 576, and a thin zone 580 engaging upper deck 414 as shown in FIG. 10. For example, thick zone 582 can be one and one-half times the thickness of thin zone 580. In one preferred embodiment, the thick zone is approximately 7½ inches (19 cm) thick and the thin zone is 5 inches (12.7 cm) thick. Thick zone 582 is positioned to carry the majority of the weight of a person (shown in phantom) supported on sleeping surface 552 to maximize the comfort of the person. Having perimetral thin zone 580 provides a perimetral portion of mattress 550 that appears to the person on sleeping surface 552 to be firmer than thick zone 582, facilitating entry onto and exit from sleeping surface 552 along sides 578 of mattress 550.

As can be seen, step deck 414 and mattress 550 can be used in many applications requiring a support surface for supporting a person. For example, step deck 414 and mattress 500 can be configured for use as a stretcher to be carried by caregivers and as a gurney having step deck 414 mounted on a frame with wheels for transporting the person supported by the gurney.

Articulating deck 402 is the surface upon which the mattress 550 rests as shown in FIGS. 11–13. Deck 402 is illustratively segmented into head, seat, thigh, and foot sections 404, 406, 408, 410, three of which, head section 404, thigh section 408, and foot section 410, may be rotated to change the angle of inclination of the back, thighs, and lower legs of the person (not shown) with respect to seat section 408. Seat section 406 of deck 402 remains horizontal and the head, thigh, and foot sections 404, 408, 410 of deck 402 can move relative to the seat section 406 and relative to each other, thereby moving the head, thigh, and foot portions 558, 562, 564 of mattress 550 relative to seat portion 560 of mattress 550 and relative to each other.

The head, seat, thigh, and foot sections 404, 406, 408, 410 of articulating deck 402 cooperate to define a step deck 412 as shown best in FIGS. 11–13. Step deck 412 includes an upper deck 414 having a head end upper deck portion 416 appended to head end 52 of head section 404, side upper deck portions 418, 420, 422, 424, 426, 428 appended to sides of the head, seat, and thigh sections 404, 406, 408, and a foot end upper deck portion 460 appended to foot end 54 of weigh frame 506 adjacent to thigh section 408. The upper deck portions 416, 418, 420, 422, 424, 426, 428, 460 and a top surface 411 of foot section 410 are coplanar when articulating deck 402 is in the initial position and cooperate to form upper deck 414 which is generally parallel to weigh frame 506.

Step deck 412 also includes a lower deck 430 having a head slat 432, a seat slat 434, and a thigh slat 436. Head, seat, and thigh slats 432, 434, 436, are coplanar when articulating deck 402 is in the initial position and they cooperate to form lower deck 430 which is generally parallel to weigh frame 506 and to upper deck 414 when articulating deck 402 is in the initial position.

Lower deck 430 is connected to upper deck 414 by a wall 438 including a head end wall 440 connecting head slat 432 to head end upper deck portion 416, side walls 442, 444, 446, 448, 450, 452 connecting head, seat, and thigh slats 432, 434, 436 to side upper deck portions 418, 420, 422, 424, 426, 428, and a foot end wall 454 connecting thigh slat 436 to foot end upper deck portion 460 as shown in FIG. 11. Step deck 412, then, comprises upper deck 414 and is formed to include a central, longitudinally extending recess 456 defined by lower deck 430 and by wall 438 connecting lower deck 430 to upper deck 414. In the preferred embodiment, foot section 410 of step deck 412 is displaced from recess 456 and forms part of upper deck 414, as shown in FIGS. 11 and 13.

Foot section 410 of articulating deck 402 is movable from a generally horizontal up position parallel to intermediate frame 302 as shown in FIGS. 1 and 3 to a generally vertically downwardly extending down position to permit the lower legs and feet of the person (not shown) to be lowered to the sitting position as shown in FIGS. 2 and 8. Foot section 410 can also be contracted from an expanded position having a longitudinal length 465 as shown in FIGS. 3, 24, and 13 to a contracted position having foot end 54 of foot section 410 drawn inwardly toward head end 52 of chair bed 50 so that foot section 410 has a longitudinal length 464 that will "clear" the floor when foot section 410 moves to the down position as shown in FIGS. 8 and 25. Preferably, length 464 of foot section 410 when foot section 410 is contracted is such that foot end 54 of foot section 410 clears the floor and is spaced-apart therefrom sufficiently to permit a base (not shown) of an over bed table (not shown) to fit therebetween.

Foot section 410 is pivotably coupled to an upper deck end portion 460 of thigh section 408 by hinge 468 as shown in FIG. 13. Consequently, foot section 410, when in the down position, can be longer by an amount equal to a vertical offset 514 between lower deck 430 and upper deck 414 than it could be if there were no step deck 412, and foot section 410 were instead connected to lower deck 430. Thus, for foot section 410 to clear the floor when foot section 410 pivots from the up position to the down position, foot section 410 can contract a lesser amount than would be required if there were no step deck 412.

Mattress 550 is received by articulating deck 402 and includes a projection 576 sized to be received by recess 456 as shown in FIGS. 11 and 12. Consequently, mattress 550 is thinner along sides 580 of mattress 550 where mattress 550 engages upper deck 414 of step deck 412. Conversely, mattress 550 is thicker in portions adjacent to projection 576. Preferably, projection 576 is positioned directly beneath portions of mattress 550 carrying a majority of the weight of the person on sleeping surface 552. The thick portion of mattress 550 including the thickness of mattress 550 between sleeping surface 552 and a bottom surface 586 engaging upper deck 414 plus the thickness of projection 576 provides greater comfort for the person on sleeping surface 552. Mattress 550, then, has a thinner perimetral zone 580 and a thicker body-support zone 582 adjacent to projection 576. Preferably, body support zone is 1½ times the thickness of perimetral zone 580. For example, perimetral zone can be 5 inches (12.7 cm) thick and body-support zone 582 can be 7½ inches (19 cm) thick.

Thinner perimetral zone 580 and upper deck side portions 417 cooperate to define "rammed" edges that provide greater firmness around the edges of sleeping surface 552 as the result of sleeping surface 552 being in closer proximity to upper deck 414. This increased firmness is advantageous when the person enters and exits the bed along the sides of the bed.

Figure 14:
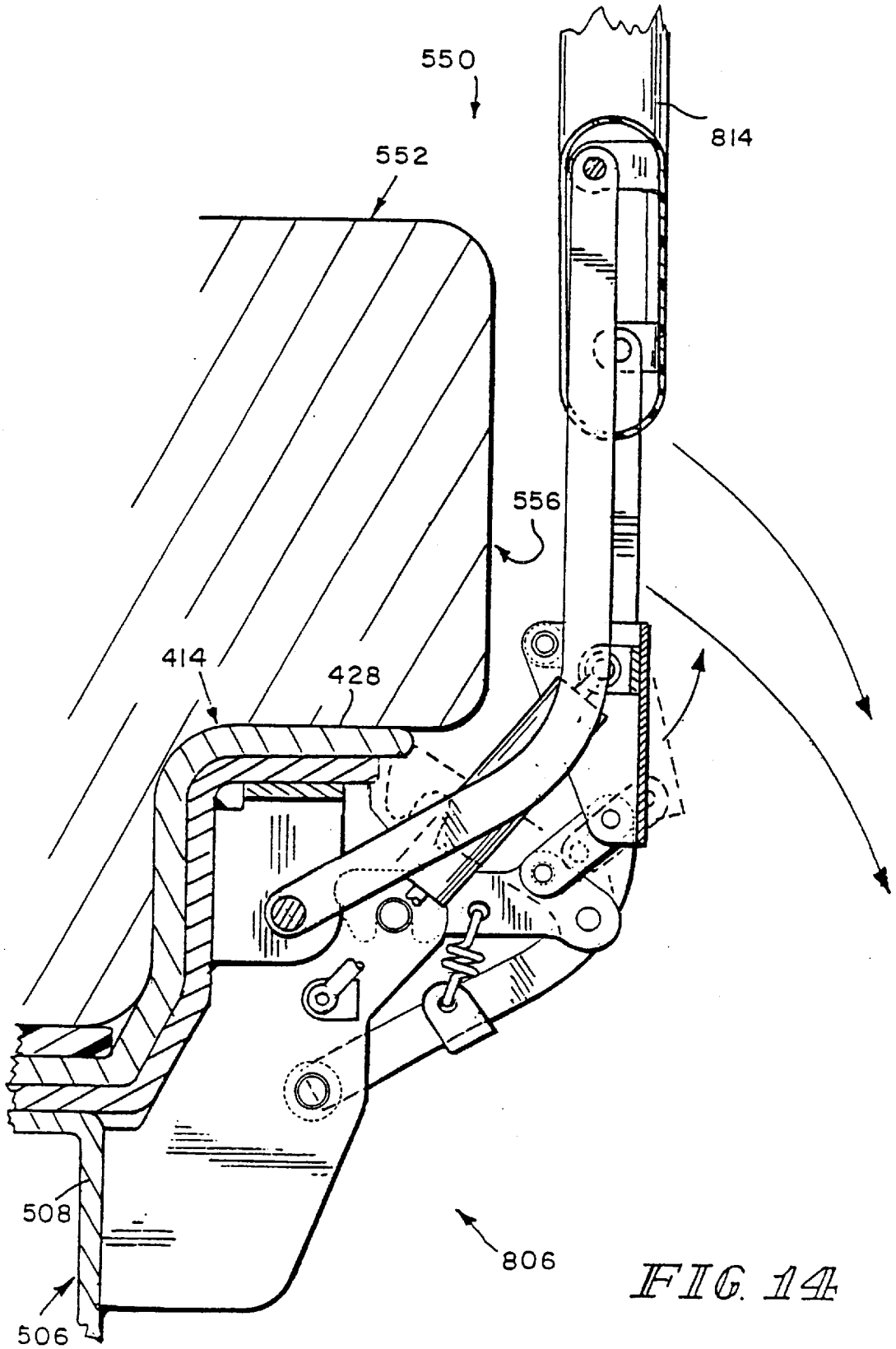
FIG. 14 is a sectional view taken along line 14—14 of FIG. 1 of a side rail in a patient-restraining position.
Figure 15:
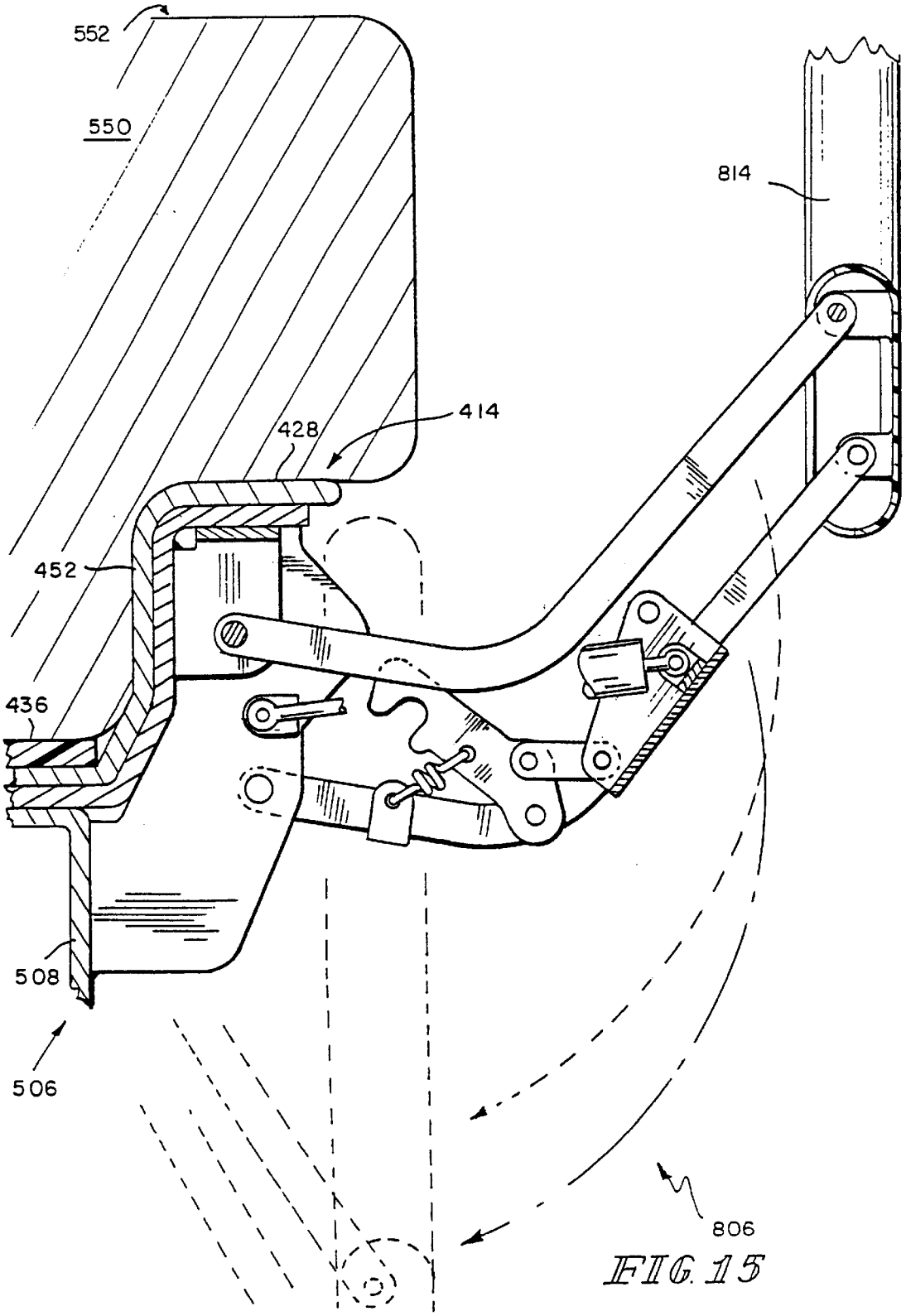
FIG. 15 is a view similar to FIG. 14 of the side rail intermediate the patient-restraining position of FIG. 14 and a down-out-of-the-way position (in phantom) having a top of the side rail beneath the sleeping surface.

Additionally, the rammed edges provide a firm edge that cooperates with side rail assemblies 800, 802, 804, 806 to minimize the potential for side rail entrapment, in which an object becomes wedged between sleeping surface 552 and one of side rails 808, 810, 812, 814. Also, step deck 412 cooperates with side rail assemblies 800, 802, 804, 806 to maximize the height relative to sleeping surface 552 at which side rails 808, 810, 812, 814 are mounted as shown in FIGS. 14 and 15. Tops of side rails 808, 810, 812, 814 can be higher when in the patient-restraining position for improved coverage and protection of the person (not shown) on sleeping surface 552 and bottoms 814 can be higher when in the tucked position for improved access to base frame 62 and to the space beneath intermediate frame 302.

Projection 576 includes a side wall 584 that can be configured to engage at least portions of the wall 438 of step deck 412 as shown in FIG. 12, thereby preventing lateral and longitudinal sliding of mattress 550 relative to step deck 412. Also, mattress 550 includes sides 578 connecting sleeping surface 552 and bottom surface 586. Mattress 550 and step deck 412 are configured so that sides 578 of mattress 550 are exposed above deck 402 as shown in FIGS. 11 and 12 providing the caregiver greater and easier access to mattress 550, rather than engaging a portion of a frame or upstanding walls of a deck as is found with conventional mattress and deck systems.

In preferred embodiments, sleeping surface 550 is generally planar and projection 576 is centrally located beneath sleeping surface 550 to form thick body support zone 582 of mattress 550 surrounded by perimetral zone 580 engaging upper deck 414. Mattress 550 may be provided in more than one piece, for example, mattress 550 may comprise a first mattress piece fit into recess 456 and a second mattress piece surrounding and abutting sides of the first mattress piece and engaging upper deck 414, or a first mattress piece could fit into recess 456 and a second mattress piece having a planar bottom surface could fit over the first mattress piece so that the bottom of the second mattress piece engages the first mattress piece and upper deck 414. However, a one-piece mattress 550 including both body-support zone 582 and perimetral zone 580 is preferred.

Use of step deck 412 can additionally improve access of equipment to portions of chair bed 50 as shown in FIG. 12. A C-arm 588 carrying equipment 590, 592 and having equipment 590 positioned to lie above sleeping surface 552 and equipment 592 positioned to lie below step deck 412 can be positioned near chair bed 50. C-arm 588 is C-shaped having an inner surface 594 and a point 596 on inner surface 594 that is the maximum lateral distance on inner surface 594 away from equipment 590, 592. An edge 598 of upper deck 414 is positioned to lie a distance 600 above lower deck 430 of step deck 412. While a conventional deck bottom (not shown) would have an edge (not shown) engaging C-arm 588 away from point 596, edge 598 of step deck 412 engages C-arm adjacent to point 596, thereby maximizing the area of sleeping surface 552 across which equipment 590, 592 can be located.

Additionally, head slat 432 can have a radiolucent portion 510 made from a radiolucent material that is transparent to X-rays thereby permitting X-rays to pass therethrough as shown in FIGS. 11 and 12. Equipment 590, 592 can be radiography equipment used to produce images such as X-ray images or photographs of the person (not shown) on sleeping surface 552. Having step deck 412 arranged to engage point 596 of C-arm 588 maximizes the area of sleeping surface 552 away from edge 598 that equipment 590, 592 can be positioned, thereby maximizing the area of sleeping surface 552 on which the person can be positioned to lie while fluoroscopic procedures are performed on the person.

Chair bed 50 is typically provided with side rail assemblies 800, 802, 804, 806 as shown in FIGS. 1,2 14, and 15. Side rail assemblies 800, 802, 804, 806 include head section side rails 808, 810 mounted to head section 404 of articulating deck 402, and body section side rails 812, 814 mounted to weigh frame 506 adjacent to thigh section 408 of deck 402.

Head section side rails 808, 810 are mounted to move with head section 404 as head section 404 pivots relative to weigh frame 506 between the down position and the back-support position as shown in FIGS. 11 and 31–33. Body section side rails 812, 814 are mounted to weigh frame 506 and do not move relative to weigh frame 506 and seat section 406 when head, thigh, and foot sections 404, 408, 410 of articulating deck 402 move. Head section side rails 808, 810 are shorter than body section side rails 812, 814 and extend only adjacent head section 404, whereas body section side rails 812, 814 extend adjacent head and body (seat and thigh) sections 404, 406, 408. Both of the head section and body section side rails 808, 810, 812, 814 are configured to maintain a between-rail gap 866 of approximately 2–3 inches as head section 404 moves between the back-support position and the down position.

Side rails 808, 810, 812, 814, are passive restraint devices mounted on both sides of chair bed 50 as shown in FIGS. 14 and 15. The principles discussed below with respect to body section side rail assembly 806 pertains to each side rail assembly 802, 804, 806. In the upward patient-restraining position shown in FIG. 14, side rail 814 is a vertical barrier that can abut side 556 of mattress 550 and extending above sleeping surface 552 to restrain movement of the person past side 556 of sleeping surface 552, thereby preventing the person from rolling out of chair bed 50. Side rail 814 may also be lowered below sleeping surface 552 of mattress 550 to a tucked position shown in phantom in FIG. 15 beneath side portion 428 of upper deck 414 to permit the person to move past side 556 of sleeping surface 552 when entering or exiting chair bed 50. Lowering side rails 808, 810, 812, 814 also provides the caregiver with clear access to the patient.

Although the invention has been described in detail with reference to preferred embodiments, variations and modifications exist within the scope and spirit of the invention as described and defined in the following claims.

We claim:

1. A bed for supporting a mattress having a top surface and a bottom surface, the bed having a head end, a foot end and two opposing sides, the bed comprising:

a frame, a deck carried by the frame, the deck including an upper deck portion and a central, longitudinal recess in the upper deck portion, the recess being defined by a lower deck portion defining a plane and a side wall connecting the lower and the upper deck portions, the lower deck portion providing a support surface to support the bottom surface of the mattress with the top surface of the mattress extending above the upper deck, and a side rail coupled to the bed below the upper deck portion, the side rail having a patient-restraining position located above the upper deck portion and having a tucked position in which a top end of the side rail is located between the upper deck portion and the plane defined by the lower deck portion.

2. The bed of claim 1, wherein the side rail has a bottom end, the bottom end of the side rail being positioned to lie above the upper deck portion when the side rail is in the patient-restraining position.

3. The bed of claim 2, wherein the upper deck portion has a bottom surface, the bottom surface and the side wall of the deck define a storage niche for receiving the top end of the side rail when the side rail is in the tucked position.

4. The bed of claim 1, wherein said deck includes a head, seat and foot sections, further comprising a pair of side rails on each side of said bed, each pair of side rails including a body section side rail mounted to move with said deck seat section and a head section side rail mounted to move with said deck head section relative to said body section side rail, and each of said side rails is coupled to the bed below the upper deck portion and positionable in a patient-restraining position located above the upper deck portion and in a tucked position in which a top end of each side rail is located between the upper deck portion and the lower deck portion.

5. The bed of claim 1, wherein the upper deck portion surrounds the recess.

6. A bed having a mattress including upper mattress section having a planar top surface and a central projection extending downwardly from the upper mattress section, the central projection having a bottom surface and a side wall, the bed comprising a frame, and an articulating deck coupled to the frame, the deck including a head supporting section, a seat supporting section, and a foot supporting section, the head, seat, and foot supporting sections being longitudinally spaced apart and movable relative to each other to move the bed between a bed configuration and a chair configuration, the head and seat supporting sections each including an upper deck, a lower deck coupled to the upper deck by a deck side wall so that the lower deck is spaced apart from the upper deck to define a recess receiving the central projection of the mattress, the lower deck providing a lower support surface engaging the bottom surface of the central projection with the side wall of the central projection being located adjacent the deck side wall, the head supporting section being pivotally coupled to the seat supporting section about a pivot axis positioned adjacent the upper deck and above the lower deck.

7. The support assembly of claim 6, wherein said recess is spaced from said foot supporting section.

8. The bed of claim 6, wherein the deck side wall is adjacent the side wall of the mattress central projection to prevent lateral and longitudinal movement of the mattress relative to the deck.

9. The bed of claim 6, wherein the upper deck is a continuous upper deck surrounding the recess.

10. The bed of claim 6, wherein the foot supporting section is pivotally mounted to said seat supporting section adjacent said upper deck to move between a generally horizontal up position and a generally vertical down position.

11. The support assembly of claim 6, wherein the foot supporting section is movable between a generally horizontal up position and a generally vertical down position, the foot supporting section contracting from a first length when the foot section is in the up position to a second length when the foot section is in the down position, the second length being less than the first length.

12. The bed of claim 11, wherein the mattress includes a foot portion adjacent to the deck foot supporting section, the mattress foot portion is inflated when the foot section is in the up position and deflated when the foot section is in the down position.

13. The bed of claim 6, wherein the mattress has an inner zone above said recess of a first thickness and an outer zone above the upper deck of a second thickness, and the first thickness is generally twice the second thickness.

14. The bed of claim 6, including at least one patient-restraining side rail mounted to said deck between said upper deck and said lower deck.

15. The bed of claim 6, further comprising a pair of side rails on each side of said bed, each pair of side rails including a body section side rail mounted to the frame adjacent said deck seat supporting section and a head section side rail mounted to move with said deck head supporting section relative to said body section side rail.

16. The bed of claim 15, wherein the side rails are pivotally mounted to said deck side wall.

17. The bed of claim 15, wherein each side rail includes a top and a bottom and is movable between a patient-restraining position in which the rail bottom is positioned to lie above the upper deck and a tucked position in which the rail top is positioned to lie beneath and tucked under the upper deck.

18. The bed of claim 17, wherein the top of the side rail is positioned to lie above the lower deck when the side rail is in the tucked position.

19. The bed of claim 6, wherein the mattress further includes an inflatable and deflatable foot portion.

20. A bed convertible between a chair position and a bed position, the bed having a mattress including an upper mattress section having a top surface and a central projection extending downwardly from the upper mattress section, the central projection having a bottom surface and a side wall, the bed comprising a frame, an articulating deck coupled to the frame, the deck including a head section, a seat section, and a foot section, the head, seat, and foot sections being longitudinally spaced apart and movable relative to each other as the bed moves between the bed position and the chair position, the head and seat sections each including an upper deck, a lower deck coupled to the upper deck by a deck side wall so that the lower deck is spaced apart from the upper deck to define a recess configured receiving the central projection of the mattress, the lower deck providing a lower support surface supporting the bottom surface of the central projection with the side wall of the central projection being located adjacent the deck side wall, the foot section being pivotally coupled to the seat section, the foot section being configured to contract from a first length to a second length less than the first length as the bed moves from the bed position to the chair position, the foot section expanding from the second length to the first length as the bed moves from the chair position to the bed position.

21. The bed of claim 20, wherein the upper deck surrounds the recess and said foot deck section is located in a plane defined by said upper deck and spaced from said recess.

22. The bed of claim 21, wherein the foot deck section is coupled to the deck seat section to pivot about a pivot axis located adjacent the upper deck.

23. The bed of claim 20, wherein said recess has a transverse width and said deck foot section has a transverse width substantially equal to said recess transverse width of the recess.

24. The bed of claim 20, wherein the deck foot section includes a pivoting member pivotally mounted to the frame for movement about the pivot axis and a contracting member movably coupled to the pivoting member.

25. The bed of claim 24, said mattress including a foot portion on said deck foot section, and said mattress foot portion contracts and expands between said first length and said second length with said deck foot section.

26. The bed of claim 25, wherein said mattress foot decreases and increases in thickness with the contraction and expansion respectively.

27. The bed of claim 20, wherein the deck is adjustably mounted on said frame to be lowered with respect to said frame when the deck foot section is said second length.

28. The bed of claim 27, wherein the deck foot section is movable to a generally vertical downwardly extending down position and the deck foot section is contracted to the second length when the foot section is in the down position so that the foot section is spaced apart from the floor when the foot section is in the down position and the frame is in a low position.

29. The bed of claim 28, wherein the deck foot section is movable to a generally horizontal up position and the foot section is expanded to the first length when the foot section is in the up position to provide a desired length of the foot section when the foot section is in the up position independent of the length of the foot section when the foot section is in the down position.

30. The bed of claim 20, wherein the deck foot section pivots between a generally horizontal up position and a generally vertical downwardly extending down position, the mattress including a foot portion adjacent to the deck foot section, and the mattress foot portion being inflated when the foot section is in the up position and being deflated when the foot section is in the down position.

31. The bed of claim 20, wherein the mattress has an inner zone above said lower deck portion of a first thickness and an outer zone above the upper deck portions of a second thickness, and the first thickness is generally twice the second thickness.

32. The bed of claim 31, wherein the deck foot section forms part of the upper deck and is spaced from the recess.

33. The bed of claim 32, wherein the mattress includes an inflatable and deflatable foot portion on the deck foot section.

34. A bed for supporting a mattress, the bed including a frame, a deck coupled to the frame, the deck having a head supporting section, foot support section and a seat supporting section, the head and seat supporting sections including an upper deck and a lower deck coupled by and extending from a deck side wall to define a recess in the head and seat supporting sections, the lower deck being configured to support a bottom surface of the mattress and the upper deck being configured to support an outer perimeter of the mattress, and the foot supporting section being a planar part of the upper deck and being of a length to support a calf and a foot and coupled to the seat supporting section.

35. The bed of claim 34, wherein the head and seat supporting sections have a first width and the foot supporting section has a second width, less than the first width.

36. The bed of claim 34, wherein the head supporting section is pivotably coupled to the seat supporting section about a pivot axis located adjacent the upper deck.

37. The bed of claim 34, wherein the head, seat, and foot supporting sections are movable relative to each other to convert the bed from a bed position to a chair position, the foot supporting section contracting from a first length to a second length shorter than the first length as the bed moves from the bed position to the chair position, the foot supporting section expanding from the second length to the first length as the deck moves from the chair position to the bed position.

38. The bed of claim 34, further comprising a side rail coupled to one of the head supporting section and seat supporting section, the side rail being movable between a patient-restraining position located above the upper deck and a tucked position in which a top end of the side rail is located between the upper deck and the lower deck.

* * * * *